US006238247B1

(12) United States Patent
Belopolsky et al.

(10) Patent No.: US 6,238,247 B1
(45) Date of Patent: May 29, 2001

(54) ELECTRICAL CONNECTOR WITH RETAINING DEVICE FOR RELEASABLY RETAINING COMPONENT PACKAGE THEREIN

(75) Inventors: Yakov Belopolsky, Harrisburg; James A. Somerville, Hershey, both of PA (US)

(73) Assignee: Berg Technology, Inc., Reno, NV (US)

( * ) Notice: Subject to any disclaimer, the term of this patent is extended or adjusted under 35 U.S.C. 154(b) by 0 days.

(21) Appl. No.: 09/401,139

(22) Filed: Sep. 22, 1999

(51) Int. Cl.[7] ..... H01R 13/66
(52) U.S. Cl. ..... 439/620
(58) Field of Search ..... 439/620, 607, 439/676

(56) References Cited

U.S. PATENT DOCUMENTS

| | | | | |
|---|---|---|---|---|
| 4,726,638 | | 2/1988 | Farrar et al. | 439/620 R |
| 4,772,224 | | 9/1988 | Talend | 439/607 |
| 5,015,204 | | 5/1991 | Sakamoto et al. | 439/620 |
| 5,069,641 | | 12/1991 | Sakamoto et al. | 439/620 |
| 5,456,619 | | 10/1995 | Belopolsky et al. | 439/620 |
| 5,736,910 | * | 4/1998 | Townsend et al. | 333/181 |
| 5,971,805 | * | 10/1999 | Beloposky et al. | 439/620 |

FOREIGN PATENT DOCUMENTS

| | | |
|---|---|---|
| 64-2273 | 1/1989 | (JP) . |

* cited by examiner

*Primary Examiner*—Gary F. Paumen
*Assistant Examiner*—Phuongchi Nguyen
(74) *Attorney, Agent, or Firm*—Woodcock Washburn Kurtz Mackiewcz & Norris LLP

(57) ABSTRACT

An electrical connector has an insulative housing, a plurality of first contacts extending through the housing for electrically contacting conductors in a mating connector, and a cover releasably secured to the housing and contacting at least one of the plurality of first contacts.

22 Claims, 7 Drawing Sheets

ELECTRICAL CONNECTOR WITH RETAINING DEVICE FOR RELEASABLY RETAINING COMPONENT PACKAGE THEREIN

FIELD OF THE INVENTION

The present invention relates to an electrical connector which has a component package and a retaining device that releasably retains the component package within the connector. More particularly, the present invention relates to such a connector where the retaining device at least partially shields the component package.

BACKGROUND OF THE INVENTION

Electrical connectors, including electric components such as modular jacks, can use various types of filters to reduce or eliminate noise, and can use LEDs to indicate a system status. Such filters may include a three terminal capacitor or a common mode choke coil. A disadvantage in the use of such filters is that they may complicate the production of the connector. A need, therefore, has been perceived for providing a filtered electrical connector or an electrical connector with one or more LEDs that are assembled in a relatively simple manner.

The use of an integral ferrite element for this purpose is proposed in Japanese Patent Publication 64-2273. This reference discloses a modular jack having a modular insert installed in a casing. The body of the insert is formed with ferrite, and on one side of the insert body insert holes are formed for introducing connecting lines to be connected to respective contact springs.

While this reference would appear to simplify the apparatus used for noise filtering in modular jacks, such filtered connector is larger than a comparable non-filtered connector. Thus, a need exists for further increasing the compactness of such filtered connector.

U.S. Pat. No. 5,456,619 discloses a filtered modular jack assembly having an outer insulative housing with open front and rear sides. A ferrite element with vertical conductive wires is positioned adjacent the rear end, and an elongated insulative insert is superimposed over the ferrite element. The insulative insert is fixed to the housing, and the conductive wire extends vertically from the ferrite element over the upper side of the insert to its terminal end and then bends downwardly and rearwardly to rest on the top surface of an interior medial wall in the housing. The connector, however, cannot interchange various filters. Accordingly, a need still exists for a connector jack which can achieve such compactness while using multiple types of filtering elements.

A need also exists for such a connector that can securely removably receive any of a plurality of components, such as a filter element, LED, or the like, as mounted within or on a component package, especially in the field. Accordingly, if in the field or elsewhere it is determined that one component is not desired or is not operating properly, the component package there-having may simply be removed from the jack, and be replaced by another component package having a more suitable component. A need further exists for such a connector that is properly shielded.

SUMMARY OF THE INVENTION

The aforementioned need is satisfied by the present invention, in which an electrical connector has an insulative housing, a plurality of first contacts extending through the housing for electrically contacting conductors in a mating connector, and a cover releasably secured to the housing and contacting at least one of the plurality of first contacts.

In one embodiment of the present invention, a modular jack releasably receives a component package having an exterior surface, a plurality of first conductive elements mounted on the exterior surface, and at least one electric device mounted thereon and electrically coupled to the first conductive elements. The jack has an insulative insert mounted within an interior section of an insulating housing. The insert has a forward portion and a rear portion, where the rear portion defines a recess for receiving the component package therein. The recess defines a mouth thereof, and the component package is received within the recess through the mouth thereof. Each first conductive element of the component package resides at a respective predetermined location within the recess when the component package is received within the recess.

A plurality of first contacts are mounted to the forward portion of the insert to electrically contact conductors in a connector inserted toward the forward portion of the insert and into the jack. Each first contact corresponds to a first conductive element in the component package, extends from the forward portion of the insert generally to the predetermined location of the corresponding first conductive element, and terminates at a termination in communication with such predetermined location. The termination of each first contact electrically contacts the corresponding first conductive element at the respective predetermined location when the component package is received within the recess. A retaining device is releasably secured over the mouth of the recess to releasably retain the component package as received in the recess.

BRIEF DESCRIPTION OF THE DRAWINGS

The filtered modular jack assembly of the present invention is further described with reference to the accompanying drawings in which.

DETAILED DESCRIPTION OF PREFERRED EMBODIMENTS

Referring now to FIGS. 1–5, wherein like numerals are used to indicate like elements throughout, one type of modular jack is shown for purposes of disclosing typical features in modular jacks. As will be seen in FIGS. 6–10, wherein like numerals are also used to indicate like elements throughout, the modular jack of the present invention shares many common features with the modular jack shown in FIGS. 1–5.

Figure 1:
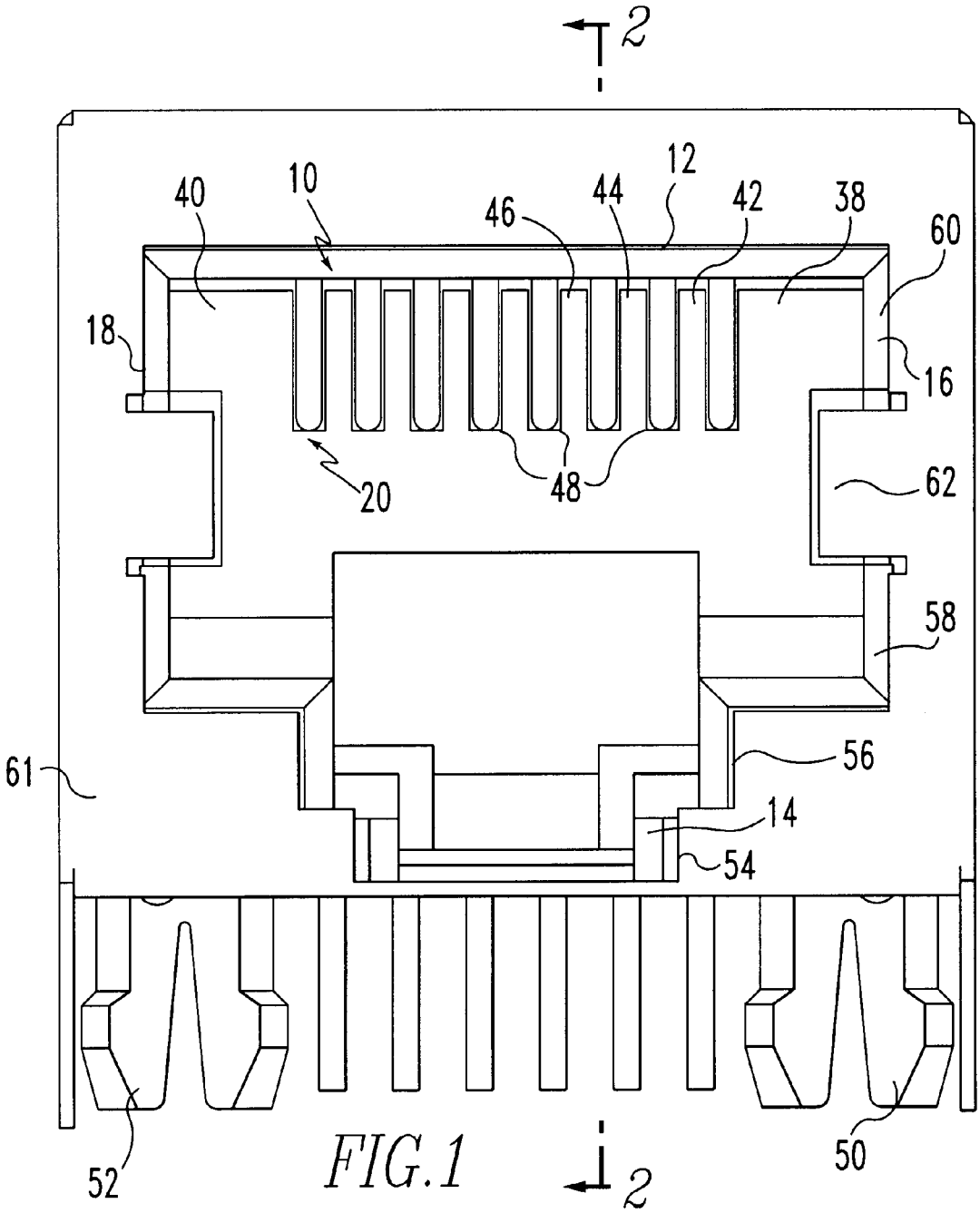
FIG. 1 is a front elevational view of one type of modular jack.
Figure 2:
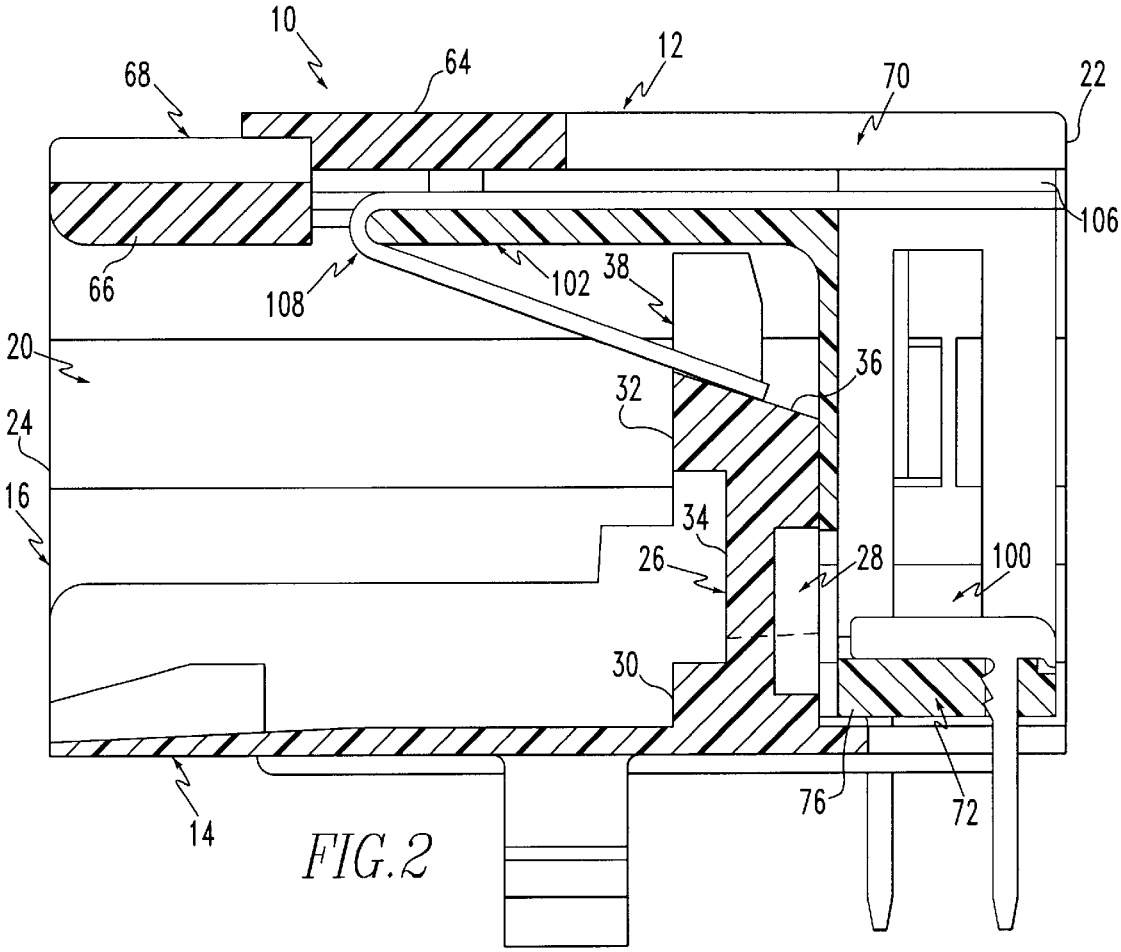
FIG. 2 is a cross sectional view through 2—2 in FIG. 1 in which for the purpose of showing other detail, shielding, a filter, and associated wires and a rear cap have been deleted.

As seen in FIGS. 1 and 2, the modular jack has an outer insulative housing which is shown generally at numeral 10. This housing includes a top wall 12, a bottom wall 14 and a pair of opposed lateral walls 16 and 18. The housing could be constructed of a thermoplastic polymer having suitable insulative properties and may have conventional metallic exterior shielding 61. Within these walls is an interior section 20 which has a rear open end 22 and a forward open end 24. Projecting upwardly from the bottom wall in this interior section there is a medial wall generally shown at numeral 26 which has a rear side 28 and a front side shown generally at numeral 30 which includes a bottom front side 31, a top front side 32, a recessed medial front side 34, and an inclined top side 36 which slopes upwardly and forwardly from its rear side toward its front side. Adjacent to the lateral walls, the medial wall has lateral extensions 38 and 40 which serve as projections to retain other elements as will be hereafter explained. Interposed between these lateral extensions there are a plurality of wire separation extensions as at 42, 44 and 46 and between these wire separation extensions there are plurality of slots as at 48.

Figure 3:
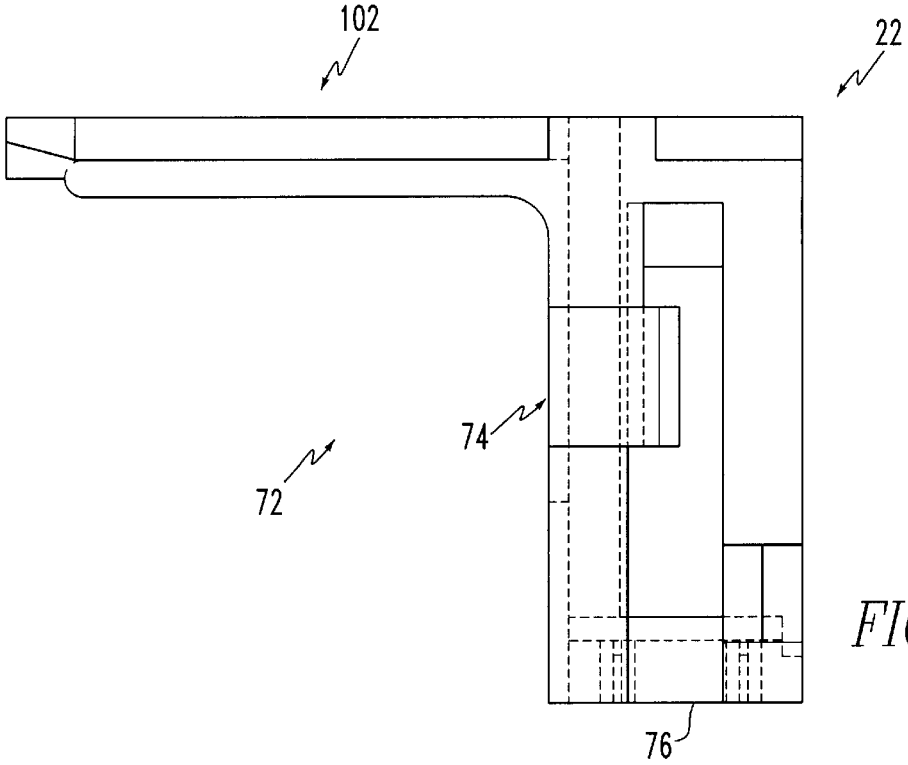
FIG. 3 is a side elevational view of an insulative insert used in the modular jack shown in FIG. 1.
Figure 4:
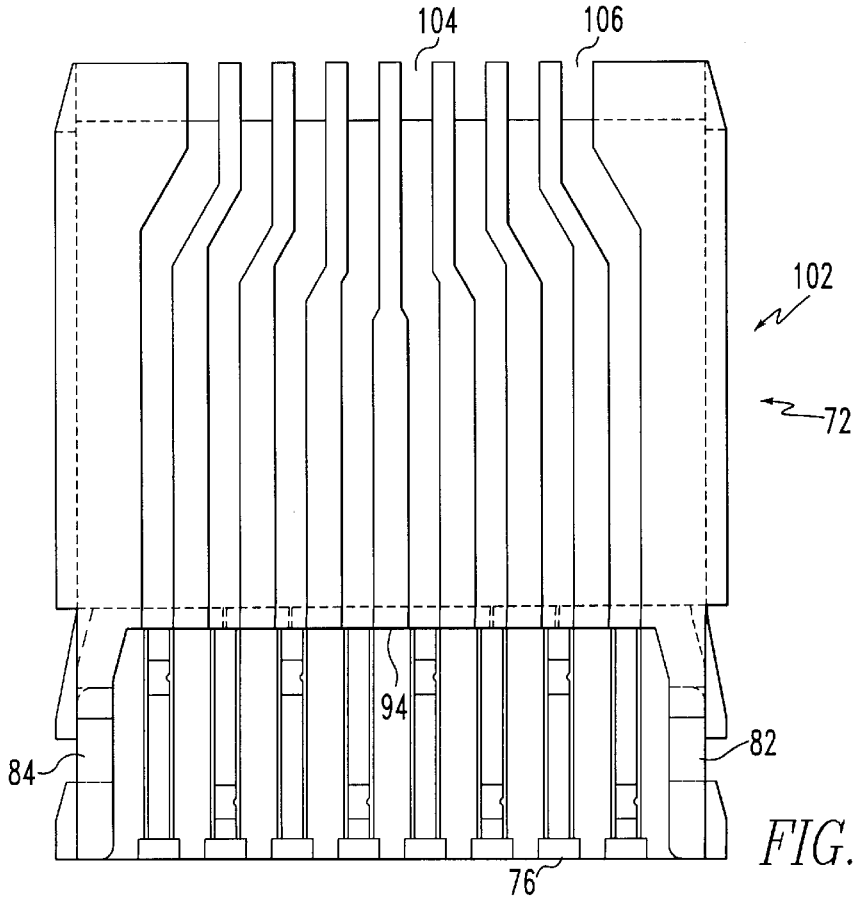
FIG. 4 is a top plan view of the insulative insert shown in FIG. 3.

As will be appreciated and as further explained hereafter, the wall and recesses of the outer insulative housing may interact to receive an insulative insert 72 (best seen in FIGS. 3 and 4). In the type of insert 72 shown in the drawings, each conductor in the jack is part of/mounted to such insert 72. Alternatively, the housing 10 could have terminals that correspond to such conductors (not shown) so as to make electrical connection between the conductors in the housing 10 and the insert 72. Importantly, the housing 10 and the insert 72 may be formed as a substantially unitary body without departing from the spirit and scope of the present invention.

Extending downwardly from the bottom wall there are alignment and retention posts 50 and 52. The lateral wall 16 includes a lower shoulder 54, another shoulder 56, a lower main wall 58, an upper main wall 60 and a recess interposed between the lower and upper main wall 58, 60 to receive a tab 62 of shield 61 when a plug (not shown) enters the jack. It will be seen that the lateral wall 18 has substantially identical features as lateral wall 16. The top wall 12 includes an upper bridge section 64, a lower bridge section 66, a front recess 68 and a rear recess 70.

Referring particularly to FIGS. 3 and 4, the insulative insert which may be received by the housing 10 is shown generally at numeral 72. This insert 72 has a vertical section shown generally at numeral 74 which includes a base wall 76. The vertical section also includes opposed side walls 82 and 84. The vertical section also has a front wall 94 in which there are apertures 96 and 98. Finally the vertical section 74 of the insert 72 defines a recess 100. The insert also has a horizontal section shown generally at numeral 102 which has a plurality of grooves as at groove 104 and 106 which extend from the rear to the front of this horizontal section. In these grooves there are conductors as at wire 108 (FIG. 2).

Figure 5:
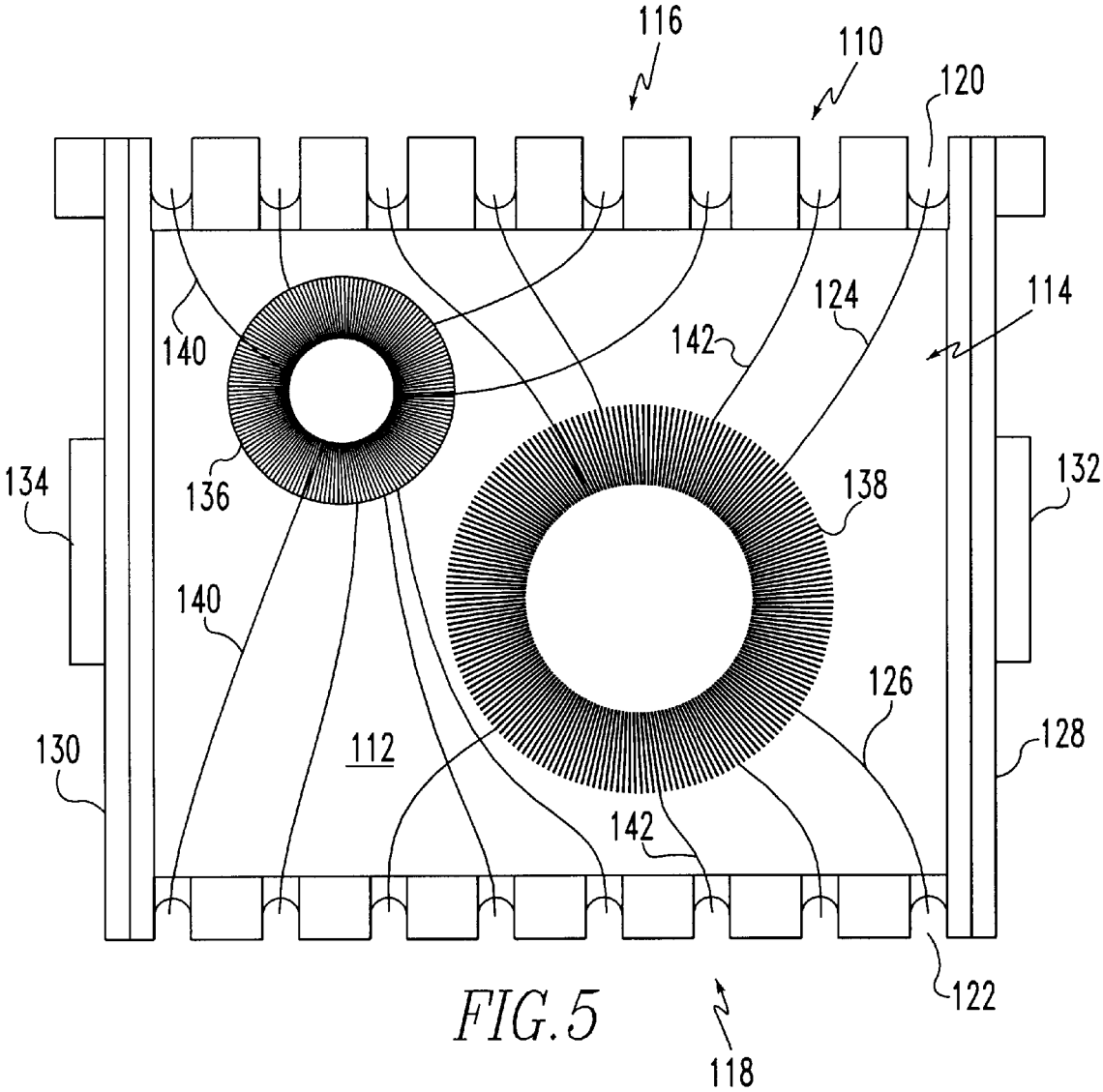
FIG. 5 is an interior view of a cap element used in the modular jack shown in FIG. 1.

Referring particularly to FIG. 5, a cap element which may be mounted to the insert 72 is shown generally at numeral 110. This cap element 110 has a rear wall 112 and defines a recess 114 therein. The cap also has a top end wall 116 and a bottom end wall 118 which have respectively grooves as at groove 120 and 122. Conductors as at wire 124 and 126 are positioned in each of these grooves. The cap also has side walls 128 and 130 which have respectively latches 132 and 134 for engaging the side walls 82 and 84 of the insulative insert. A filter means such as common mode chokes 136 and 138 may be mounted on the inner or recess side of the wall 112, as is more filly discussed in U.S. patent application Ser. No. 08/863,654, hereby incorporated by reference. Other filtering elements such as inductive serial filters, differential filters, low pass capacitive filters and other magnetic filters may be substituted for the common mode choke.

It will be appreciated that a compact modular jack as shown in FIGS. 1–5 facilitates the use of several different types of filtering elements depending on specific needs. That is, a large variety of filters or other components may be housed in the recess of the insert. Consequently, the use of a standard package as is required in many prior art modular jacks is not necessary so as to allow greater flexibility in meeting specific application needs. It will also be appreciated, however, that the filtering element or the like in the jack of FIGS. 1–5 is not normally removable once inserted. Accordingly, if in the field or elsewhere it is determined that one filter element or the like or other suitable electric device is not desired, such filter element or the like or other electric device cannot simply be removed from the jack and be replaced by another more suitable filter element or the like.

Referring now to FIGS. 6–10, it is seen that in contrast to the jack of FIGS. 1–5, an electrical connector such as modular jack 200 of the present invention accommodates a component package 202 having a suitable electric device 203, where the component package 202 is in fact removably insertable and therefore exchangeable in the field or elsewhere with other component packages 202 having other suitable electric devices 203. Thus, and as described above, if it is determined that one electric device 203 is not desired, the component package 202 there-having may simply be removed from the jack 200, and be replaced by another component package 202 having a more suitable electric device 203.

Figure 6:
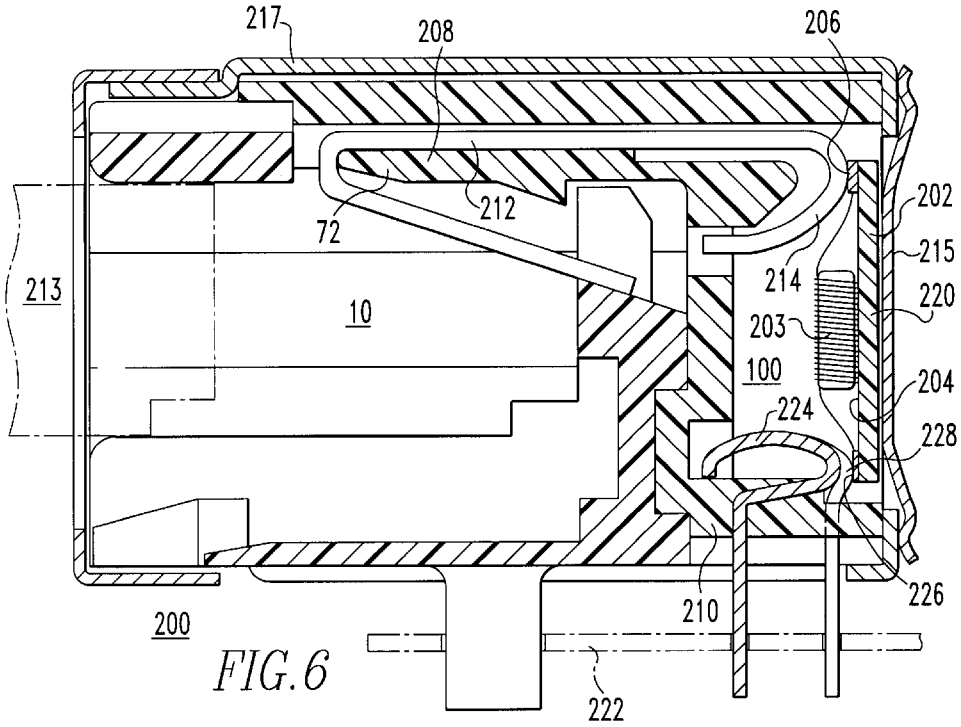
FIG. 6 is a cut away side elevational view of a modular jack with retaining device in accordance with a first embodiment of the present invention.
Figure 7:
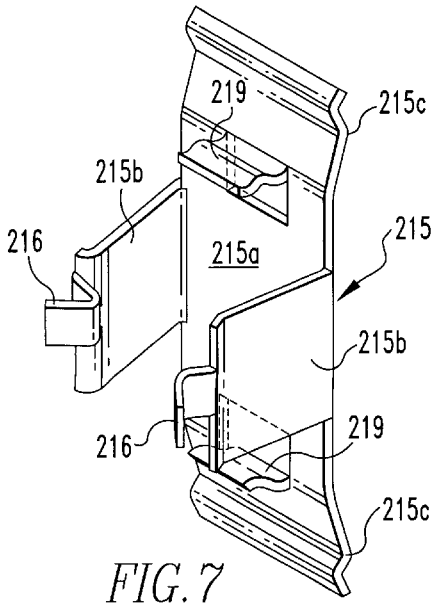
FIG. 7 is a perspective view of a retaining device employed in connection with the jack of FIG. 6.

In particular, and referring now to FIG. 6, the modular jack 200 of the present invention is similar to the jack shown in FIGS. 1–5 in that such jack 200 has an insert 72 with walls that define a recess 100, where the insert 72 is mounted within an interior section of an insulating housing 10. Notably, the housing 10 and the insert 72 of the jack 200 may be formed as a unitary body without departing from the spirit and scope of the present invention. Here, the recess 100 securely removably receives the component package 202 having an electric device 203 therein.

As should be understood, the electric device 203 may be the aforementioned filter, LED, or the like or any other electric device that may be received in/secured to the component package 202 such that at least a portion of the component package 202 may be received in the recess 100. For example, the electrical device 203 may be a resistor or capacitor, a simple electronic circuit, an antenna, a complex integrated circuit, etc.

Figure 8:
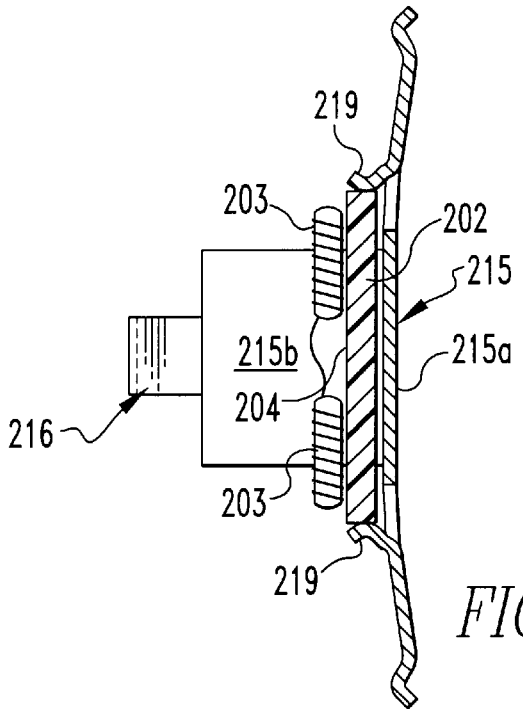
FIG. 8 is a cut away side elevational view of the retaining device of FIG. 7.

As seen in FIG. 6, the component package 202 has a substrate with a first surface 204, a plurality of first conductive elements 206 mounted on the surface 204, and at least one electric device 203 mounted thereon and electrically coupled to the first conductive elements 206. In one embodiment of the present invention, and as seen in FIG. 8, the component package 202 could use a circuit substrate such as a generally planar circuit board with magnetics mounted thereto, where the circuit board includes the first conductive elements 206 and the magnetics are appropriately coupled thereto. In another embodiment of the present invention (not shown), the component package 202 could be an integral module with circuitry encapsulated therein. Of course, other types of component packages 202 may be employed without departing from the spirit and scope of the present invention.

In terms of the present invention, the insert 72 as shown in FIGS. 1–5 may be defined to include a forward portion 208 (i.e., the horizontal section 102, generally) and a rear portion 210 (i.e., the vertical section 74, generally), where the rear portion 210 defines the recess 100 that receives at least a portion of the component package 202 therein. As seen, the recess 100 defines a mouth 220 thereof, where the component package 202 is received within the recess 100 through such mouth 220. Generally, the mouth 220 is adjacent the exterior of the jack 200, although such mouth 220 need not necessarily be immediately adjacent such jack 200 exterior. For example, the mouth 220 may be retracted somewhat into the recess 100. Again, the insert 72 is mounted within an interior section of the insulating housing 10.

As should be understood from FIG. 6, each first conductive element 206 of the component package 202 resides at a respective predetermined location within the recess 100 when the component package 202 is received within the recess 100. Each predetermined location may preferably be generally at the mouth 220 of the recess 100, as shown, although each predetermined location may be elsewhere without departing from the spirit and scope of the present invention. Moreover, each predetermined location may be at different places relative to mouth 220 of the recess 100 without departing from the spirit and scope of the present invention. For example, the predetermined locations of some of the first conductive elements 206 may be at the mouth 220 of the recess 100, while the predetermined locations of some of the other first conductive elements 206 may be farther into the recess 100.

As seen in FIG. 6, a plurality of first contacts 212 are mounted to the forward portion 208 of the insert 72. As should be understood, such first contacts 212 are for electrically contacting conductors (not shown) in a connector 213 inserted toward the forward portion 208 of the insert and into the jack 200. Each first contact 212 corresponds to a first conductive element 206 in the component package 202, in that a corresponding first contact 212 and first conductive element 206 are intended to be in electrical contact with one another. As seen, then, each first contact 212 extends from the forward portion 208 of the insert 72 generally to the predetermined location of the corresponding first conductive element 206 and terminates at a termination 214 that proximate such predetermined location.

As should now be evident, the termination 214 of each first contact 212 electrically contacts the corresponding first conductive element 206 on the exterior surface 204 of the component package 202 as received in the recess 100, where such first conductive element 206 is at such predetermined location merely on the basis of the component package 202 being properly positioned in the recess 100. In one embodiment of the present invention, one or more appropriate keying mechanisms, such as complementary slots and keys, pins and holes, etc. (not shown) may be employed to ensure such proper positioning. Such keying mechanisms may not in all cases be necessary.

In one embodiment of the present invention, and as seen in FIG. 6, each termination 214 of the plurality of first contacts 212 is a spring termination. That is, each termination 214 is constructed from a suitable material such that the termination 214 can act as a spring if biased in a particular manner. This helps accommodate tolerance differences between component packages 202 being inserted into the housing 10. Here, the spring terminations 214 may be biased toward the mouth 220 of the recess 100, whereby the terminations 214 of the plurality of first contacts 212 in combination act to urge the inserted component package 202 out of the recess 100. Accordingly, and as seen in FIGS. 6–10, the jack 200 preferably includes a retaining device 215 that is releasably secured over the mouth 220 of the recess 100 to act against the bias of the spring terminations 214 and thereby releasably retain the component package 202 as received in the recess 100. Retaining device 215 may be stamped and formed from the same conductive materials as the shield 217, such as a copper alloy. Other materials, including insulative materials, may be employed without departing from the spirit and scope of the present invention.

Figure 9:
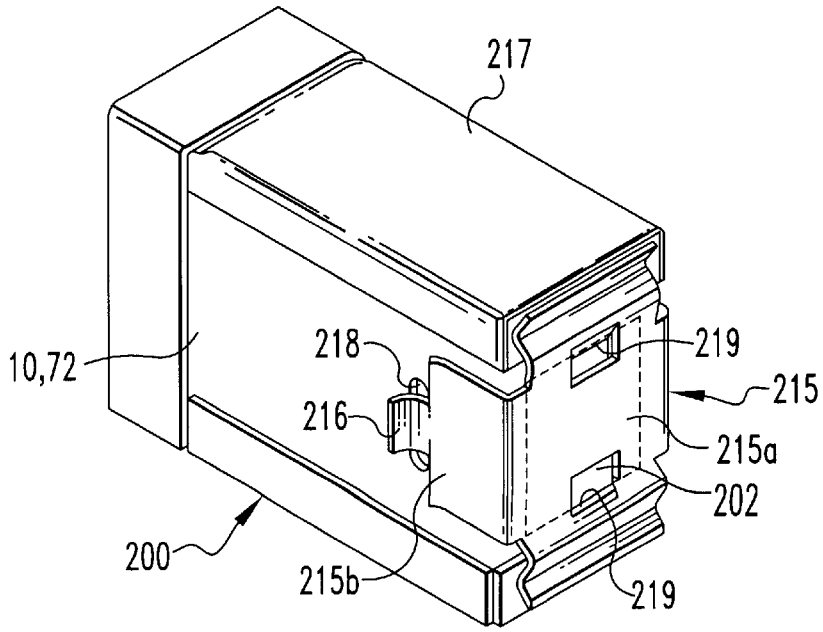
FIG. 9 is a rear perspective view of the jack of FIG. 6 along with the retaining device of FIGS. 7 and 8.

In one embodiment of the present invention, the jack 200 includes features for releasably securing the retaining device 215 to the remainder of the jack 200 against the bias of the spring terminations 214. Such features may include one or more of the aforementioned appropriate keying mechanisms. As best seen in FIG. 9, the features may include a pair of opposing latches 216 on the retaining device 215 for cooperating with a corresponding pair of opposing latch catches 218 on the housing 10 when the retaining device 215 is properly positioned over the mouth 220 of the recess 100. Alternatively, the housing 10 could have the latches 216 and the retaining device 215 could have the catches 218. Of course, other structures may be employed as the retaining device securing device 216, 218 without departing from the spirit and scope of the present invention.

In one particular embodiment, and as seen, the main body of the jack 200 (i.e., the combination of the housing 10 and the insert 72) has opposing lateral sides, where each lateral side has one of the latch 216 and the latch catch 218. Correspondingly, the retaining device 215 includes a main panel 215a for being positioned over the mouth 220 of the recess 100, and a pair of opposing arms 215b that each extend generally transversely from the main panel 215*a* and toward the main body of the jack 200, where each arm 215*b* has the other of the latch 216 and the latch catch 218. As should now be evident, the retaining device 215 is suitably sized so that when mounted to the main body of the jack 200, the arms 215*b* of such retaining device are adjacently positioned to receive and 'hug' the main body of the jack 200 therebetween, such as with an interference fit. Thus, the respective latches 216 and latch catches 218 combine and interlock to secure the retaining device 215 to the main body of the jack 200. In so doing, the component package 202 is secured to the jack such that the termination 214 of each first contact 212 electrically contacts the corresponding first conductive element 206 on the exterior surface 204 of the component package 202.

Retaining device 215 also includes tabs 215*c* that extend from the main panel 215*a*. Tabs 215*c* limit the insertion of component package 202 into recess 100 and provide additional points of contact between retaining device 215 and the external shield 217. The retaining device 215 may be separate and apart from the remainder of the jack 200 (as shown), may be unitary with shield 217, or may be coupled in some fashion to the remainder of the jack 200 (not shown) by a coupling device such as a hinge, for example. If coupled in some fashion by a coupling device, the coupling device preferably can withstand multiple cycles of coupling and un-coupling, and does not suffer any degradation such as for example fatigue.

In one embodiment of the present invention, the retaining device 215 also provides shielding. That is, the retaining device 215 is constructed from a suitable conductive/shielding material such as a copper alloy, whereby the shielding retaining device 215 at least partially shields the component package 202 from externally originating electromagnetic interference, and also shields the exterior of the jack 200 from electromagnetic interference that originates from the component package 202. Preferably, the shielding retaining device 215 along with an external shield 217 around housing 10 combine to provide adequate electromagnetic interference shielding.

In such embodiment, the jack 200 may further comprise such external jack shield 217 which is fitted over the insert 72 and housing 10 and which defines an opening corresponding to the mouth 220 of the recess 100, whereby the opening allows external access to the recess 100 through such mouth 220. Like the shielding retaining device 215, the jack shield 217 is constructed from a suitable conductive/shielding material such as a copper alloy. Thus, in combination, the jack shield 217 and the shielding retaining device 215, substantially shield the component package 202 from externally originating electromagnetic interference, and also shield the exterior of the jack 200 from electromagnetic interference that originates from the component package 202. Preferably, the shielding retaining device 215 electrically contacts the jack shield 217 when releasably secured to the jack 200 over the mouth 220 of the recess 100. Accordingly, if the jack shield 217 is electrically grounded by way of an underlying substrate 222 (FIG. 6), then so too is the shielding retaining device 215 electrically grounded. In this embodiment, each catch 218 may include an opening, a protuberance, or a depression in the side wall of the jack shield 217.

In one embodiment of the present invention, the retaining device 215 includes a component package securing structure 219 for securing the component package 202 to such retaining device 215. The component package securing structure 219 may releasably secure the component package 202, for example by way of a pair of securing clips (FIGS. 7–9), or may fixedly secure the component package 202, for example by way of a piece of adhesive tape (not shown) or in any other suitable manner. The component package securing device 215 may include one or more of the aforementioned appropriate keying mechanisms. Although physically connected, component package 202 could be electrically isolated from retaining device 215.

Accordingly, the retaining device 215 can carry the component package 202, and replacement of a component package 202 in a jack 200 is as simple as removing or 'popping out' one retaining device 215, with one component package 202 secured thereto by the component package securing structure 219 thereof, and inserting or 'popping in' another retaining device 215, with another component package 202 secured thereto by the component package securing structure 219 thereof. Alternatively, if the component package securing device releasably secures the component package 202, the retaining device 215 is removed, the component package 202 is removed from the component package securing structure 219, and another component package 202 is inserted into such component package securing structure 219. The retaining device 215 with the new component package 202 may then be popped back in to jack 200.

As is to be expected, the jack 200 is to be mounted to an underlying substrate 222 (shown in FIG. 6) such that signals pass through the jack 200 between the first contacts 212 and second contacts 224 that couple to the substrate 222. In one embodiment of the present invention, and as shown in FIG. 6, the jack 200 has a plurality of the second contacts 224 mounted to the rear portion 210 of the insert 72 for electrically contacting the underlying substrate 222. Preferably, and as seen, each second contact 224 extends from the rear portion 210 of the insert 72 to the recess 100 and terminates at a termination 228 in communication with the recess 100. Likewise, it is seen that in the present invention, the component package 202 has a plurality of second conductive elements 226 mounted on the exterior surface 204 of such package 202, where the electric device 203 on the component package 202 is electrically coupled to the second conductive elements 226. Accordingly, the termination 228 of each second contact 224 securely electrically contacts a corresponding second conductive element 226 on the exterior surface 204 of the component package 202 as received in the recess 100.

Similar to the first contacts 212 and first conductive elements 206, and as should be understood from FIG. 6, in one embodiment of the present invention, each second conductive element 206 of the component package 202 resides at a respective predetermined location within the recess 100 when the component package 202 is received within the recess 100. Each predetermined location may preferably be generally at the mouth 220 of the recess 100, as shown, although each predetermined location may be elsewhere without departing from the spirit and scope of the present invention. Moreover, each predetermined location may be at different places relative to mouth 220 of the recess 100 without departing from the spirit and scope of the present invention. For example, the predetermined locations of some of the second conductive elements 226 may be at the mouth 220 of the recess 100, while the predetermined locations of some of the other second conductive elements 226 may be farther into the recess 100.

Each second contact 224 corresponds to a second conductive element 226 in the component package 202, in that a corresponding second contact 224 and second conductive element 226 are intended to be in electrical contact with one another. As seen, then, each second contact 224 extends from the rear portion 210 of the insert 72 generally to the predetermined location of the corresponding second conductive element 226 and terminates at a termination 228 that is adjacent such predetermined location. As with the first contacts 212 and first conductive elements 206, the termination 228 of each second contact 224 electrically contact the corresponding second conductive element 226 on the exterior surface 204 of the component package 202 as received in the recess 100, where such second conductive element 226 is at such predetermined location merely on the basis of the component package 202 being properly positioned in the recess 100.

Similar to the terminations 214, in one embodiment of the present invention, and as seen in FIG. 6, each termination 228 of the plurality of second contacts 212 is a spring termination. That is, each termination 228 is constructed from a suitable material such that the termination 228 can act as a spring if biased in a particular manner. Like the spring terminations 214, the spring terminations 228 may be biased toward the mouth 220 of the recess 100, whereby the terminations 214 and 228 of the plurality of first and second contacts 212, 224 in combination act to urge the inserted component package 202 out of the recess 100. Accordingly, the retaining device 215 that is releasably secured over the mouth 220 of the recess 100 acts against the bias of the spring terminations 214 and 228. Such bias provides suitable contact force with the package 202.

In one embodiment of the present invention, and as seen in FIG. 6, the first and second conductive elements 206, 226 are located on generally opposing sides of the component package 202. However, the elements 206, 226 may also be located elsewhere without departing from the spirit and scope of the present invention.

In one embodiment of the present invention, and as best seen in FIG. 6, the first and/or second conductive elements 206, 226 mounted on the exterior surface 204 of the component package 202 comprise conductive pads that are generally coextensive with such exterior surface 204. Here, 'coextensive' means flush with respect to such exterior surface 204, or at least minimally differing in elevation with respect to such exterior surface 204. In another embodiment of the present invention (not shown), the first and/or second conductive elements 206, 226 mounted on the exterior surface 204 of the package 202 comprise conductive extending elements that extend away from such exterior surface 204. For example, the extending elements may include spring terminations or spring loops.

Figure 10:
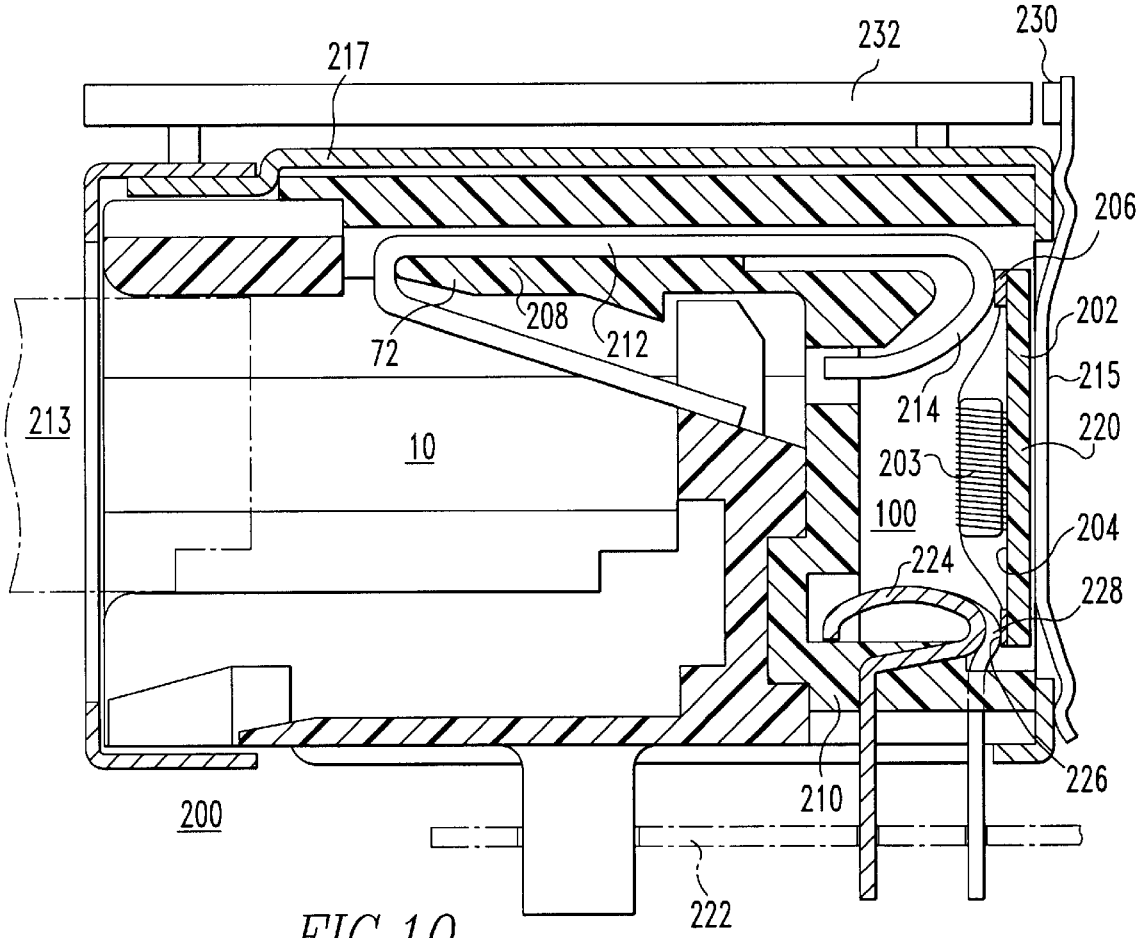
FIG. 10 is a cut away side elevational view of a modular jack with retaining device in accordance with a second embodiment of the present invention.

In one embodiment of the present invention, and as seen in FIG. 10, the component package 202 includes or is associated with one or more LEDs 230 or the like, each of which lights upon the occurrence of a pre-defined event. The LEDs 230 may reside on/in the component package 202, or may be positioned on the shielding retaining device 215 physically apart from the component package 202 but coupled thereto using suitable wiring or a flex circuit, for example. Illustratively, and as may be appreciated, one LED 230 may light when outgoing data is being transmitted, another LED 230 may light when incoming data is being received, and another LED 230 may light to show that the jack 200 is active and has a connector 213 coupled thereto. Preferably, the light from each LED 230 is communicated to the front face of the housing 10 adjacent the mouth 220 thereof. Accordingly, such light may be observed if the bulk of the jack 200 is positioned interior to a structure (such as a cabinet or the like). For example, the housing 10 may include an appropriate aperture through which such light may be seen at such front face, or may include a light pipe 232 or the like embedded therein which guides such light to such front face. Alternatively, such light pipe 232 may reside on a top or side face of the housing, as is shown.

In the present invention, a jack 200 can securely removably receive any of a plurality of electric devices as mounted within or on a component package 202, and such package 202 may be easily replaced, especially in the field, by removing a retaining device 215 that holds the component package 202 in proper position in the jack 200. While the present invention has been described in connection with the embodiments as shown in FIGS. 6–10, it is to be understood that other similar embodiments may be used or modifications and additions may be made to the described embodiments for performing the same function of the present invention without deviating therefrom. Therefore, the present invention should not be limited to any single embodiment, but rather construed in breadth and scope in accordance with the recitation of the appended claims.

What is claimed is:

1. An electrical connector comprising:

an insulative housing;

a plurality of first contacts extending through the housing for electrically contacting conductors in a mating connector; and a cover releasably secured to the housing and contacting at least one of the plurality of first contacts, the cover including a conductive shield and a structure for securing an electrical component package to the shield such that the secured package directly engages at least one of the plurality of first contacts; wherein the structure comprises clips for securely receiving the component package.

2. The electrical connector of claim 1 wherein each of the plurality of first contacts has a resilient end to engage the cover.

3. The connector of claim 1 further comprising an external shield fitted over the housing and defining an opening, the conductive shield of the cover contacting the external shield adjacent the opening.

4. The connector of claim 1 further comprising an electric component package coupled to the first contacts.

5. The connector of claim 1 further comprising a plurality of second contacts extending through the housing, contacting the cover, and corresponding to the first contacts.

6. The connector of claim 5 wherein each of the plurality of second contacts has a resilient end to engage the cover.

7. The connector of claim 1 further comprising a latch structure for releasably securing the cover to the housing.

8. The connector of claim 7 wherein the latch structure includes a catch for cooperating with a corresponding latch.

9. The connector of claim 8 wherein the latch structure comprises a pair of catches on one of the housing and a corresponding pair of latches on the cover.

10. A modular jack for releasably receiving a component package having a surface, a plurality of first conductive elements mounted on the surface, and at least one electric device mounted thereon and electrically coupled to the first conductive elements, the jack comprising:

an insulating housing having a recess for receiving the component package therein, the recess defining a mouth thereof, the component package being received within the recess through the mouth thereof, each first conductive element of the component package residing at a respective predetermined location within the recess when the component package is received within the recess;

a plurality of first contacts mounted to the housing for electrically contacting conductors in a connector inserted into the jack, each first contact corresponding to a first conductive element in the component package, extending generally to the predetermined location of the corresponding first conductive element, and terminating at a termination in communication with such predetermined location, the termination of each first contact for electrically contacting the corresponding first conductive element at the respective predetermined location when the component package is received within the recess; and a retaining device releasably secured over the mouth of the recess for releasably retaining the component package as received in the recess, the retaining device including a conductive shield and a component package securing structure for securing the component package to the shield such that the secured package directly engages at least one of the plurality of first contacts; wherein the component package securing device comprises securing clips for securely receiving the component package.

11. The jack of claim 10 wherein each predetermined location is generally at the mouth of the recess.

12. The jack of claim 10 wherein each termination of the plurality of first contacts is a spring termination.

13. The jack of claim 10 further comprising a jack shield fitted over the jack and defining an opening corresponding to the mouth of the recess, the conductive shield of the retaining device electrically contacting the jack shield when releasably secured to the jack over the mouth of the recess.

14. The jack of claim 10 further comprising the component package received within the recess.

15. The jack of claim 10 wherein the component package further has a plurality of second conductive elements mounted on an exterior surface, the at least one electric device of the component package being electrically coupled to the second conductive elements, each second conductive element of the component package residing at a respective predetermined location within the recess when the component package is received within the recess, the jack further comprising a plurality of second contacts mounted to the housing for electrically contacting an underlying substrate, each second contact corresponding to a respective second conductive element, extending from the housing generally to the predetermined location of the corresponding second conductive element, and terminating at a termination in communication with such predetermined location, the termination of each second contact for electrically contacting the corresponding second conductive element at the respective predetermined location when the component package is received within the recess.

16. The jack of claim 15 wherein each termination of the plurality of second contacts is a spring termination.

17. The jack of claim 10 further comprising an insulative insert mounted within an interior section of the insulating housing, the insert having a forward portion and a rear portion, the rear portion defining the recess for receiving the component package therein.

18. The jack of claim 17 wherein the plurality of first contacts are mounted to the forward portion of the insert, and wherein each first contact extends from the forward portion of the insert generally to the predetermined location of the corresponding first conductive element.

19. The jack of claim 10 further comprising a retaining device securing device for releasably securing the retaining device to the jack.

20. The jack of claim 19 wherein the retaining device securing device includes a pair of opposing catches for cooperating with a corresponding pair of opposing latches when the retaining device is positioned over the mouth of the recess.

21. The jack of claim 19 wherein the retaining device securing device includes a pair of opposing catches on one of the retaining device and the housing and a corresponding pair of opposing latches on the other of the retaining device and the housing for cooperating with the catches when the retaining device is positioned over the mouth of the recess.

22. The jack of claim 21 wherein the housing has opposing lateral sides, each lateral side having one of the catch and the latch, and wherein the retaining device further comprises a main panel for being positioned over the mouth of the recess and a pair of opposing arms extending generally perpendicularly with respect to the main panel and toward the main body of the jack, each arm having the other of the catch and the latch.

* * * * *